US006611183B1

(12) United States Patent
Peters

(10) Patent No.: US 6,611,183 B1
(45) Date of Patent: Aug. 26, 2003

(54) RESONANT COUPLING ELEMENTS

(76) Inventor: James Michael Peters, 104 E. Second St., Frederick, MD (US) 21701

( * ) Notice: Subject to any disclaimer, the term of this patent is extended or adjusted under 35 U.S.C. 154(b) by 0 days.

(21) Appl. No.: 09/687,309

(22) Filed: Oct. 16, 2000

Related U.S. Application Data

(60) Provisional application No. 60/159,779, filed on Oct. 15, 1999.

(51) Int. Cl.[7] ..... H01P 1/205; H01P 1/20

(52) U.S. Cl. ..... 333/206; 333/203

(58) Field of Search ..... 333/206, 203, 333/208, 202, 212, 222

(56) References Cited

U.S. PATENT DOCUMENTS

| | | | | | |
|---|---|---|---|---|---|
| 4,216,448 | A | * | 8/1980 | Kasuga et al. | 333/203 |
| 4,307,357 | A | * | 12/1981 | Alm | 333/206 |
| 5,705,965 | A | * | 1/1998 | Podvin et al. | 333/203 |
| 5,764,115 | A | * | 6/1998 | Hattori et al. | 333/202 |
| 5,936,490 | A | | 8/1999 | Hershtig | 333/202 |
| 6,025,764 | A | * | 2/2000 | Pelz et al. | 333/202 |
| 6,111,483 | A | * | 8/2000 | Haapakoski | 333/202 |
| 6,255,919 | B1 | * | 7/2001 | Smith | 333/202 |
| 6,320,482 | B1 | * | 11/2001 | Ala-Kojola et al. | 333/206 |
| 6,362,707 | B1 | * | 3/2002 | Reinhardt | 333/219.1 |

OTHER PUBLICATIONS

Workshop Notes WFHE, "Filters for Mobile Communications Networks", International Microwaves Symposium, San Diego Convention Center, May 23–27, 1994.

P.M. LaTourrette, "Wide–Bamdwith Combine Filters with High–Selectivity", 1979 MTT–S Int'l Microwave Symposium Digest, pp. 275–277.

H. Clark Bell, "Canonical Asymmetric Coupled–Resonator Filters", IEEE Transactions on Microwave Theory and Techniques, 1982, pp. 1335–1340.

* cited by examiner

*Primary Examiner*—Benny Lee
*Assistant Examiner*—Stephen E. Jones
(74) *Attorney, Agent, or Firm*—Baker Botts L.L.P.

(57) ABSTRACT

A coupled filter section is formed with a two piece construction. The filter section includes a first portion formed as a first unitary piece which has relief areas therein which define a plurality of cavities, a corresponding plurality of resonators or resonator portions located within each of the of cavities, a plurality of channels allowing magnetic coupling between adjacent cavities, and a plurality of coupling stubs disposed within the channels. The second piece is affixed to the first portion to substantially enclose the relief areas of the first portion. Preferably, the second piece includes post sections which are coaxially aligned with the resonators. The coupled filter section can include coupled triplet and coupled quadruplet sections.

15 Claims, 4 Drawing Sheets

RESONANT COUPLING ELEMENTS

The present application claims the benefit of U.S. provisional patent application Ser. No. 60/159,779, entitled RESONANT COUPLING ELEMENTS which was filed on Oct. 15, 1999.

FIELD OF THE INVENTION

The present invention is related generally to radio frequency (RF) filters and more specifically to coupling structures and methods for resonant sections in cavity filters.

BACKGROUND OF THE INVENTION

It is well known that state of the art communications systems require high performance filtering devices in order to maximize performance and comply with federal communications laws and standards. These devices are formed to be highly frequency selective by minimizing signal loss within a desired passband and significantly attenuating unwanted signals which reside outside the passband.

A known method of forming a communications filter, such as a band pass filter, is to couple multiple resonant structures which reside within one or more tuned cavities. An example of such a filter is illustrated in U.S. Pat. No. 5,936,490 to Hershtig (the '490 patent) which is directed to a filter formed with coupled tri-sections or coupled triplets. In the '490 patent, a filter is formed with three high dielectric resonators placed within corresponding cylindrical cavities which are mutually coupled either through aperture coupling or probe coupling. In aperture coupling, a small window is presented between the cavities which provides a degree of magnetic coupling between adjacent cavities. The '490 patent discloses that the amount of coupling can be adjusted by placing a tuning screw in the aperture. In probe coupling, a conductive probe, or dielectric probe is interposed between the resonant sections and is either in direct contact with the resonators or is tightly coupled thereto. The use of tuning screws is known to be problematic in that the manual adjustment is labor intensive to initially adjust and is not highly repeatable. In addition, once adjusted, the filter is subject to being detuned due to vibrations and/or thermal expansion and contraction which alter the screw position over time. Probe coupling can be problematic in that the probe must be carefully located with respect to the resonators and the tight coupling with respect to the resonator elements tends to detune the resonant elements and reduce the Q of the resonant elements.

Generally, the coupling elements for such filters may exhibit transmission line characteristics over a range of frequencies but at the frequency of interest (near the center of passband), they may be adequately described as lumped element inductors or capacitors, i.e., having a frequency response which described as either predominately inductive or capacitive. In the case of an inductive response, the element can be described as having a positive phase and for the capacitive response, the element can be described as presenting a negative phase.

As described in connection with the '490 patent, coupled triplets (ct) have three resonant elements. This filter section has an asymmetrical response, producing a single transmission zero above or below the passband depending upon the relative phase of the coupling elements. Referring to FIG. 1A , when all of the coupling elements, including the bridging element (1,3) are phase positive, this produces a zero of transmission above the passband. Alternatively if the bridging element has a negative phase, as illustrated in FIG. 1B, this produces a zero of transmission below the passband In each case, the transfer function produces an asymmetrical response, which is desired for many communication system requirements.

In addition to coupled triplets, filters can also be formed as coupled quadruplets which have tour resonant elements, as illustrated in FIG. 1C. This filter section has a symmetrical response, producing zeroes of transmission which are distributed on both sides of the passband.

Generally, when an optimal transfer function is translated into a realizable device, the performance of the resulting filter will be a function of both the realization of the resonant sections and the coupling structures. Thus, not only is it important to use high Q resonant structures, but care should be taken in the design and implementation of the coupling structures to insure that the device is easily manufacturable and lends itself to a cost effective, repeatable, high performance device. These desirable features generally preclude, or limit, the use of tuning adjustments when ever possible.

OBJECTS AND SUMMARY OF THE INVENTION

Accordingly, it is an object of the present invention to provide a coupling structure that will provide either substantially magnetic coupling or substantially electric coupling between resonant elements.

It is another objective of the present invention to provide a coupling structure that does not substantially effect the quality factors of the resonant elements being coupled.

It is a further objective of the present invention to provide a coupling structure that may be used to suppress spurious passbands of a device that incorporates the aforementioned elements.

It is yet another object of the present invention to provide a coupling structure which is readily manufacturable and results in a reliable and repeatable filtering section.

In accordance with one embodiment of the present invention, a coupled filter section is formed having a plurality of cavity sections which are arranged such that at least a portion of the cavity sections are adjacent. The adjacent cavity sections are in magnetic communication via a waveguide channel. A plurality of resonators are disposed within the cavity sections. A substantially rectangular boss is disposed in at least one of the waveguide channels. The rectangular boss has a length, a height and a width which can be selected to provide a predetermined level of coupling between adjacent resonators.

The filter section can be formed with three cavities and three resonators in a coupled triplet configuration. In this case each resonator is adjacent to the other two resonators. Alternatively, the filter section can be formed with four cavities and four resonators in a coupled quadruplet configuration. In this later case, each resonator is adjacent to two of the other resonators.

Preferably, a coupled filter section is formed with a two piece construction which includes a first portion formed as a first unitary piece having relief areas defining a plurality of cavities, a corresponding plurality of resonators located within each of the plurality of cavities, a plurality of channels allowing magnetic coupling between adjacent cavities, and a plurality of coupling stubs disposed within the channels. The filter section also includes a second portion for affixing the first portion to substantially enclose the relief areas of the first portion.

Also in accordance with the present invention is a method of manufacturing a coupled filter section. The method includes forming a first portion from a first unitary piece by establishing relief areas therein which define a plurality of cavities, a corresponding plurality of resonators located within each of the plurality of cavities, a plurality of channels allowing magnetic coupling between adjacent cavities, and a plurality of coupling stubs disposed within the channels. The method further includes forming a second portion for cooperatively engaging the first portion to substantially enclose the relief areas of the first portion and affixing the second portion to the first portion.

Preferably, the method includes altering the size of the relief areas such that the dimensions of the resonators change, thereby altering a passband of the filter section. The method can also include altering the size of the relief areas such that the dimensions of the coupling stubs change, thereby adjusting the coupling between adjacent resonators.

The method can also include forming the second portion with at least one post member extending from the second portion. The post members are formed in a position to be in substantial alignment with at least one of the resonators after the first and second portions are affixed. The method can also include adjusting the height of the posts to adjust the characteristics of the filter section.

In one embodiment, the relief areas include a plurality of annular relief areas which simultaneously define both the cavities and at least a portion of the resonators. In addition, the relief areas defining each channel can include first and second relief areas which are substantially parallel thereto and define a substantially rectangular channel with a substantially rectangular coupling stub therein.

DETAILED DESCRIPTION OF PREFERRED EMBODIMENTS

The present invention relates to coupling structures for coupled cavity filter topologies. In particular, coupled triplets (ct) and coupled quadruplets (cq) are exemplary resonant sections which can be used in forming such filters and the present coupling structures are particularly applicable to these topologies. These filter sections create finite zeroes of transmissions, the placement of which in the filter response can be used to realize optimal filter performance.

Figure 1A:
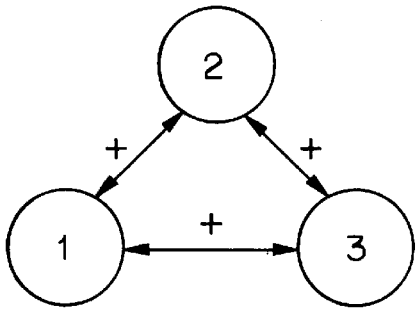
FIG. 1A PRIOR ART
FIGS. 1A–1C are schematic diagrams of conventional coupled triplet and coupled quadruplet resonant coupling structures.
Figure 1B:
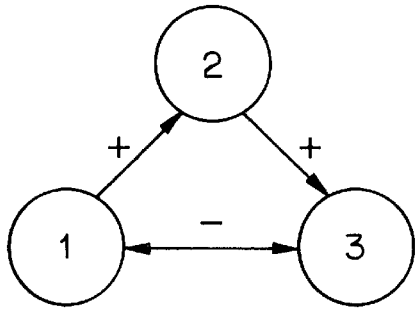
FIG. 1B PRIOR ART
Figure 1C:
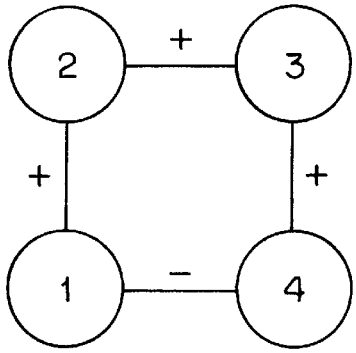
FIG. 1C PRIOR ART
Figure 2:
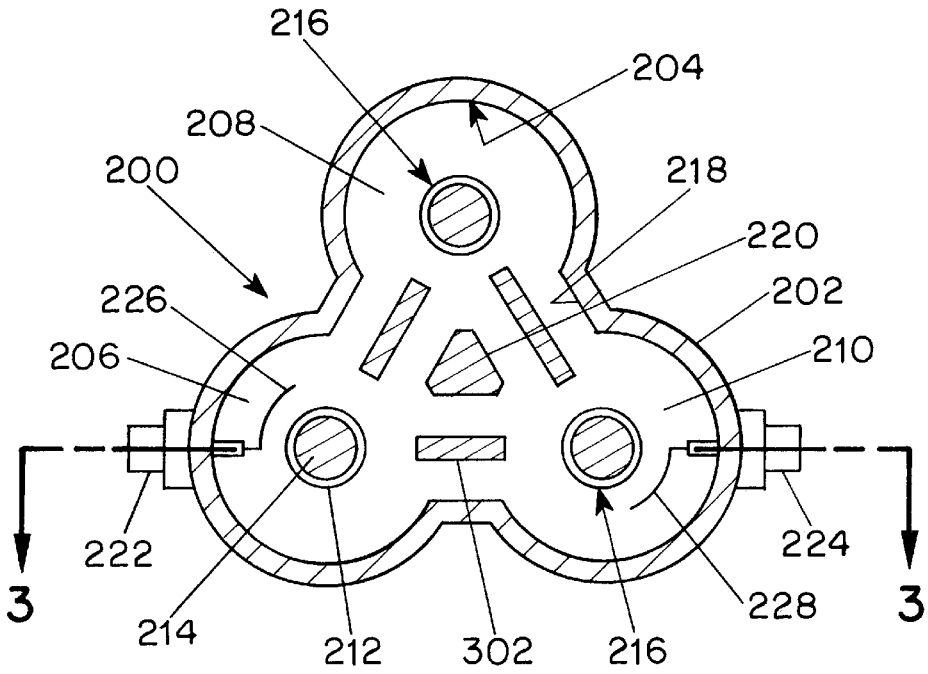
FIG. 2 is a top plan view of a coupled triplet filter section employing a resonant coupling structure formed in accordance with the present invention.

FIG. 2 is a top plan view of a coupled triplet filter section 200 having a zero of transmission above the desired passband, such as illustrated in the schematic diagram of FIG. 1A. The filter section 200 is formed with a two piece body 202 which includes a base portion 202*a* and a top portion 202*b*. The filter body 202 has an interior surface that defines three cylindrical cavity regions 206, 208, 210. The interior surface should be of a highly conductive material, such as a metal (e.g., gold, silver) or a high temperature superconductor material (e.g., ceramic). The underlying supporting material of the outer body 202 is not critical and can be formed of a metal, plastic or ceramic material. Located within each of the cylindrical cavity regions 206, 208, 210 are opposing, coaxial post pairs 216 having a lower post 212 formed on the base portion 202*a* an upper post 214 formed on the top portion 202*b*. The post pairs, in cooperation with the corresponding cavity regions, form coaxial resonant structures for the filter section 200.

Figure 3:
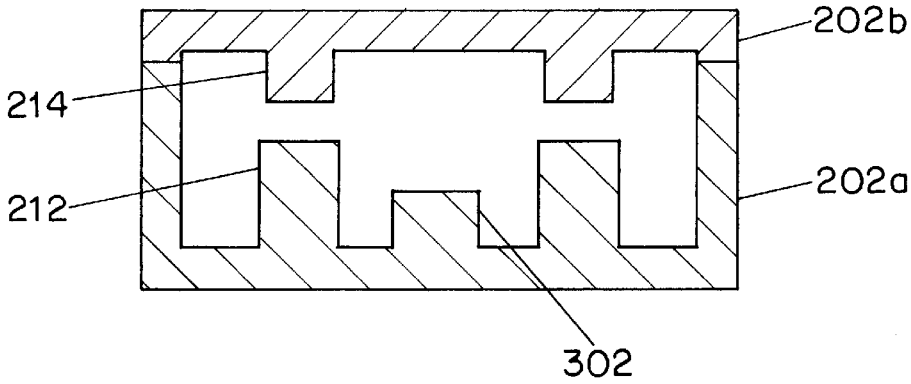
FIG. 3 is a cross sectional view of the coupled triplet filter section employing a resonant coupling structure of FIG. 2 taken along section line 2—2.

Referring to FIG. 3, the lower post 212 and upper post 214 of post pairs 216 are coaxially aligned with respect to each other and the cylindrical regions 206, 208, 210. The post pair size and separation can be altered to adjust the frequency of the resonant sections. For example, the opposing surfaces of lower post 212 and upper post 214 form capacitors, the capacitance of which can be adjusted by reducing or increasing the distance between the opposing surfaces.

Signals are coupled into the filter section 200 and out of the filter section 200 by a first connector 222 and a second connector 224, which are generally electrically interchangeable. The connectors can take on any conventional form, such as a standard coaxial SMA connector. The SMA connector has a center conductor which can be electrically and or magnetically coupled to the resonators by a number of known techniques. For example a simple wire coupling loop can be used or, as illustrated in FIG. 2, a simple curved wire 226, 228 substantially parallel to the diameter of the lower post 212 and aligned in a direction of the M-field can be used.

Adjacent cylindrical cavity sections, e.g., 208, 210, are magnetically interconnected by small sections of straight wall 218 defined in the inner surface of the base portion 202*b*. In the center of the interior region of the filter section 200 is a substantially triangular post with wall sections 220 generally opposing the straight walls 218 and forming substantially rectangular channels between adjacent cylindrical sections 206. 208, 210. These channels form waveguides which couple the adjacent cylindrical cavity sections. Rectangular bosses 302 are provided within the rectangular channels and form a magnetic coupling element between the sections. The bosses 302 extend upward from the base portion 202*a* and are aligned with a major axis directed substantially parallel to walls 218 and 220. The degree of coupling between the resonant sections is related to the length, height and width of the bosses 302 with respect to the lower post 212. In addition, the boss 302 will exhibit a resonant frequency which may be altered to aid in the suppression of spurious passbands of the device. This resonant frequency is also related to the length, height and width of the bosses 302. As a result, there are three degrees of freedom available to adjust the coupling and frequency of spurious suppression and these two parameters can be achieved by suitable selection of the rectangular boss dimensions. The rectangular cross section of the boss 302 also provides an advantage when the base portion 202*a* is formed by milling regions of relief from a unitary block to form the lower posts 212 and bosses 302. In this regard, the rectangular cross section is easily formed by cutting parallel regions of relief, thereby forming boss 302 with the material between the regions of relief as well as wall section 218 and wall section 220.

It will be appreciated that while the rectangular cross section is preferred, the shape of bosses 302 are not limited to a rectangular cross section and that various geometries can also be used to provide the desired coupling and spurious suppression. Further, the use of this coupling element is not limited to coupled triplet resonant structures, but is also suitable for use with coupled quadruplets and other coupled cavity designs.

In the structure as illustrated in FIGS. 2 and 3, the resonant sections are TEM structures. However, these sections may also operate in evanescent waveguide mode. The mode of operation depends upon geometry of the resonant sections and frequency of operation.

As noted above, the filter section 200 is a two piece construction with a base portion 202*a* and an upper portion 202*b*. These pieces can be formed in a number of ways such that each piece is a substantially unitary construction. For example, the pieces can be molded or milled from a blank using a numerically controlled milling machine. In either case, the lower posts 212 and bosses 302 are part of the unitary construction of the base portion 202*a* and the upper posts 214 are preferably formed as part of a unitary construction of the top portion 202*b*.

At the interface between the surfaces of the base portion 202*a* and the top portion 202*b*, the surfaces can be formed to interlock with one other to establish a tighter enclosure for radio frequency radiation. This interface can include mating ridges, tongue and groove structures and the like, which are well known in the art of radio frequency design. The top portion 202*b* can be affixed to the base portion 202*a* in any manner which establishes a substantially uniform mechanical and electrical interface. For example, a number of screws (not shown) can be placed about the perimeter. Alternatively, a conductive epoxy can also be used for substantially permanently affixing the two portions.

In cases where filters having a number of different parameters may be required, the base portion 202*a* can be formed as a master blank where the lower post 212 and bosses 302 are initially formed with sufficient height to accommodate all frequency and coupling requirements. Then, to tune the blank for a desired passband the length of the lower post 212 can be reduced as required, such as by milling. Similarly, the degree of coupling can be adjusted by reducing the height of the boss 302 from the initial length presented in a master blank. Similarly, the upper post 214 can be formed with an initial length which is reduced, such as by milling, if required. Once the desired dimensions are established the filter construction lends itself to highly repeatable manufacturing, especially when numerically controlled milling machines are used to establish the dimensions of the bosses and resonator posts. Further, once the filter is constructed, its parameters are very stable over time, vibration and temperature.

Figure 4:
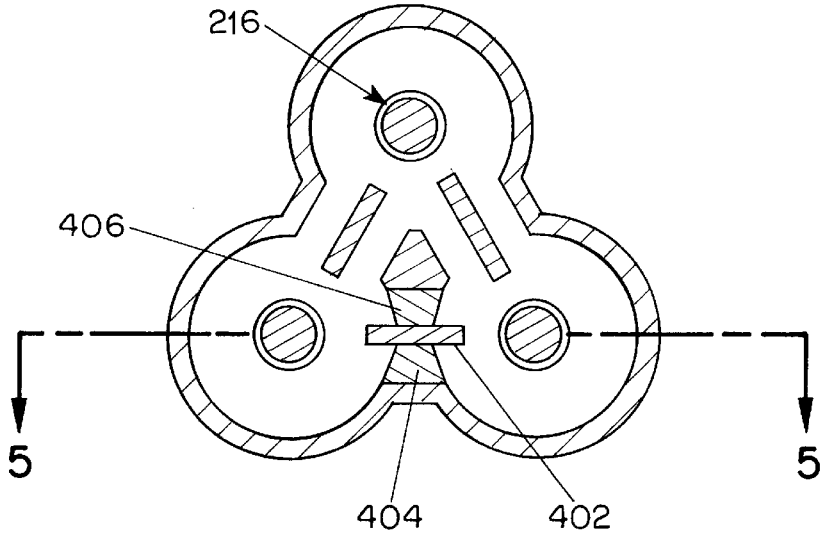
FIG. 4 is a top plan view of an alternate embodiment of a coupled triplet filter section employing a resonant coupling structure formed in accordance with the present invention.
Figure 5:
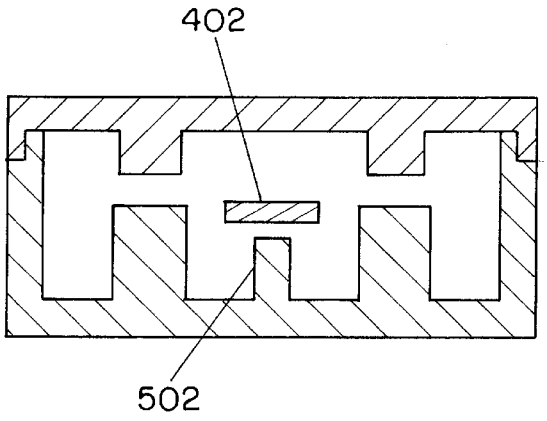
FIG. 5 is a cross sectional view of the coupled triplet filter section employing a resonant coupling structure of FIG. 4 along line 4—4.

FIG. 4 illustrates a coupled triplet filter section which exhibits a zero of transmission which is below the passband of the filter. The filter section is formed in substantially the same manner as described in connection with FIGS. 2 and 3 except in the construction of the coupling element between resonant sections. Referring to FIG. 4, a cylindrical element 402 is provided which is suspended between adjacent post pairs 216 by a first support element 404 and a second support element 406. The support elements are generally formed from a low loss dielectric material to minimize the influence on the coupling characteristics. The axis of the cylindrical element 402 is directed substantially along an imaginary line connecting the center lines of adjacent post pairs. Referring to FIG. 5, the cylindrical element is disposed above a rectangular boss 502. The amount of coupling between the resonant sections is largely related to the length and diameter of the cylindrical element 402. It will be appreciated that the shape of the cylindrical element is not limited to a circular cross section.

The cylindrical element 402 exhibits a resonant frequency which can be selected in part to aid in the suppression of the spurious passbands of the filter. It will be appreciated that the use of this coupling element structure is not limited to coupled triplet resonant structures, but is generally applicable to various coupled resonator topologies, such as coupled quadruplets.

Figure 6:
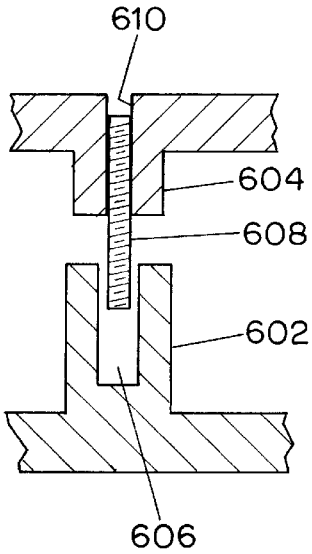
FIG. 6 is a cross sectional view of an alternate embodiment of a resonant structure which is adjustable.

As has been noted above, for many applications it is desirable to eliminate the presence of adjustments or minimize the number of adjustments in the filter structure. The use of the structures illustrated in FIGS. 2–5 provide embodiments where the resulting structure can achieve this result. However, should an adjustable filter arrangement be desired, the present invention can still be applied. For example, FIG. 6 illustrates an alternate embodiment of the lower post 602 and upper post 604 which can be used as the post pairs in the filter section. In this alternate embodiment the lower post 602 has a bore 606 therein for receiving a threaded post 608 which is engaged in a threaded bore 610 of the upper post 604. The diameter of the bore 606 is selected to be larger than the outer diameter of post 608 such that the post can reside within the lower post 602 in a coaxial relationship thereto. The amount of extension of post 608 into 606 can be adjusted by turning the post 608 with a suitable tool, such as an Allen wrench, which can extend into the bore 610 and engage the end of post 608.

Figure 7:
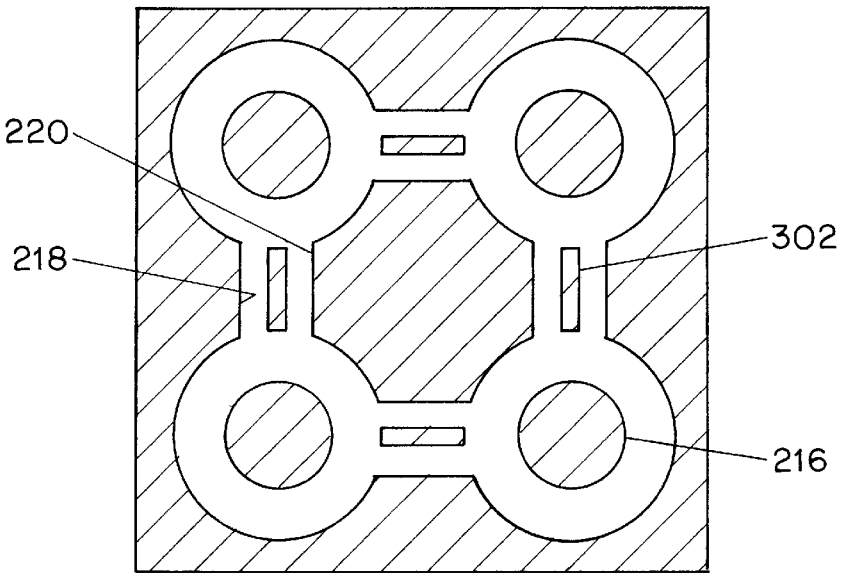
FIG. 7 is a top plan view of a coupled quadruplet filter section employing a resonant coupling structure formed in accordance with the present invention.

The coupling structures of FIGS. 2–5 have been discussed in connection with a coupled triplet configuration. However, it will be appreciated that these principals can be applied to a coupled quadruplet as well, such as is illustrated in FIG. 7.

Figure 8:
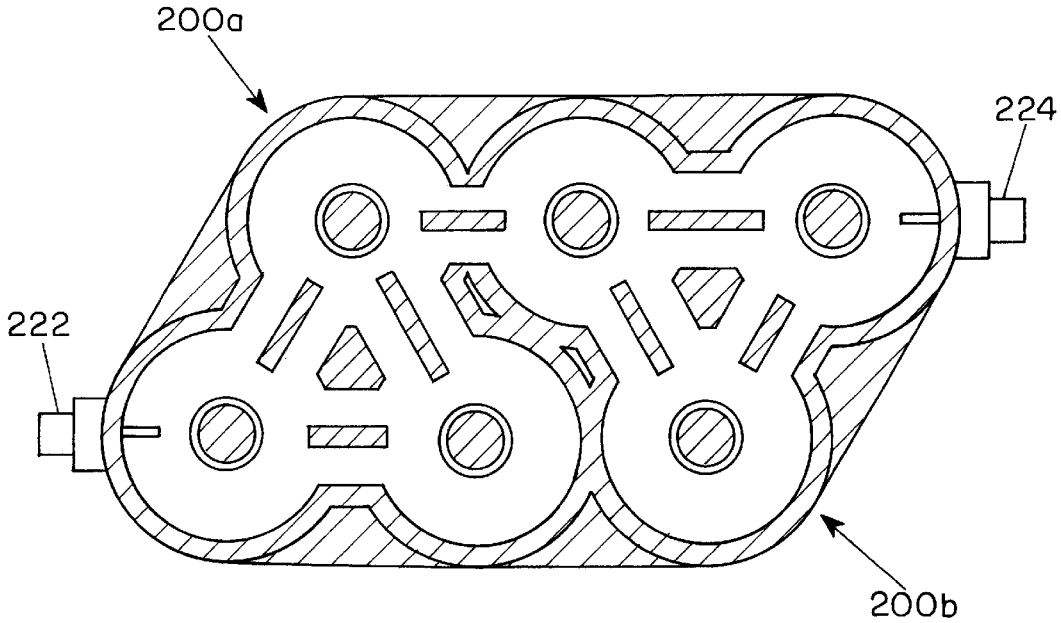
FIG. 8 is a top plan view of a filter structure formed by joining two filter sections in accordance with the present invention.

The coupled triplet and coupled quadruplet filter sections are building blocks for other structures, such as filters, diplexers and the like. These building blocks can be readily combined, as is illustrated in the exemplary filter of FIG. 8, which is formed using two coupled triplet filter sections 200*a*, 200*b*.

The invention has been described in connection with the preferred embodiments thereof. It will be appreciated that various chances and modifications can be made to such embodiments by those skilled in the art. Such changes and variations are within the scope of the present invention which is set forth in the appended claims.

What is claimed is:

1. A coupled filter section comprising:

a first portion formed as a first unitary piece, said first unitary piece having relief areas defining each of:

a plurality of cavities, a corresponding resonator located within each of said plurality of cavities, a plurality of channels allowing magnetic coupling between adjacent cavities, and a plurality of coupling stubs disposed within said channels; and a second portion for affixing to said first portion to substantially enclose the relief areas of said first portion.

2. The coupled filter section of claim 1, wherein the plurality of cavities includes three cavities, said cavities being arranged such that each cavity is adjacent to the other two cavities, and said plurality of channels includes three channels.

3. The coupled filter section of claim 2, wherein each of the three channels has a first wall and a second wall substantially parallel thereto and wherein said coupling stubs have a substantially rectangular cross section having opposing major surfaces, said opposing major surfaces being substantially parallel to said first and second wall.

4. The coupled filter section of claim 3, wherein the plurality of cavities are substantially cylindrical and wherein said resonators are substantially coaxially disposed within the corresponding cylindrical cavities.

5. The coupled filter section of claim 4, wherein said second portion includes three post sections, said post sections being substantially coaxially aligned with said resonators.

6. The coupled filter section of claim 1, wherein the plurality of cavities includes four cavities, said cavities being arranged such that each cavity is adjacent to two cavities, and said plurality of channels includes four channels.

7. The coupled filter section of claim 6, wherein each of the four channels has a first wall and a second wall substantially parallel thereto and wherein said coupling stubs have a substantially rectangular cross section having opposing major surfaces, said opposing major surfaces being substantially parallel to said first and second wall.

8. The coupled filter section of claim 7, wherein the plurality of cavities are substantially cylindrical and wherein said resonators are substantially coaxially disposed within the corresponding cylindrical cavities.

9. The coupled filter section of claim 8, wherein said second portion includes four post sections, said post sections being substantially coaxially aligned with said resonators.

10. A method of manufacturing a coupled filter section comprising:

forming a first portion from a first unitary piece by establishing relief areas defining each of: a plurality of cavities, a corresponding resonator located within each of said plurality of cavities, a plurality of channels allowing magnetic coupling between adjacent cavities, and a plurality of coupling stubs disposed within said channels;

forming a second portion for cooperatively engaging said first portion to substantially enclose the relief areas of said first portion; and affixing the second portion to said first portion.

11. The method of claim 10 further comprising:

altering the size of the relief areas such that the dimensions of the resonators change and thereby alter a passband of the filter section; and altering the size of the relief areas such that the dimensions of the coupling stubs change thereby adjusting the coupling between adjacent resonators.

12. The method of claim 11, wherein said forming said second portion includes forming at least one post member extending from said second portion and positioned to be in substantial alignment with at least one of said resonators.

13. The method of claim 10, wherein said relief areas include a plurality of annular relief areas which define both the cavities and resonators.

14. The method of claim 13, wherein the relief areas defining each channel include first and second relief areas which are substantially parallel thereto and define a substantially rectangular channel with a substantially rectangular coupling stub therein.

15. The method of claim 10, wherein the relief areas defining each channel include first and second relief areas which are substantially parallel thereto and define a substantially rectangular channel with a substantially rectangular coupling stub therein.

* * * * *

UNITED STATES PATENT AND TRADEMARK OFFICE

CERTIFICATE OF CORRECTION

PATENT NO. : 6,611,183 B1
DATED : August 26, 2003
INVENTOR(S) : James Michael Peters It is certified that error appears in the above-identified patent and that said Letters Patent is hereby corrected as shown below:

Title page,
Item [56], References Cited, OTHER PUBLICATIONS, "P.M. LaTourrette," reference, "Wide-Bamdwith" should read -- Wide-Bandwidth --; and "Combine" should read -- Combline --
Item [57], ABSTRACT,
Line 1, "two piece" should read -- two-piece --

Column 1,
Line 53, "which described" should read -- which can be described --

Column 2,
Line 6, "tour" should read -- four --
Line 19, "when ever" should read -- whenever --
Line 28, "effect" should read -- affect --
Line 55, "two" should read -- two- --

Column 3,
Lines 40, 46 and 50, "cross sectional" should read -- cross-sectional --

Column 4,
Line 6, "two piece" should read -- two-piece --
Line 34, "and or" should read -- and/or --

Column 5,
Line 19, "two piece" should read -- two-piece --

UNITED STATES PATENT AND TRADEMARK OFFICE

CERTIFICATE OF CORRECTION

PATENT NO. : 6,611,183 B1
DATED : August 26, 2003
INVENTOR(S) : James Michael Peters It is certified that error appears in the above-identified patent and that said Letters Patent is hereby corrected as shown below:

Column 6,
Line 21, “provide” should read -- provides --
Line 49, “chances” should read -- changes --

Signed and Sealed this

Twenty-third Day of March, 2004

JON W. DUDAS
*Acting Director of the United States Patent and Trademark Office*